United States Patent [19]

Keller

[11] Patent Number: 4,497,611

[45] Date of Patent: Feb. 5, 1985

[54] DEVICE FOR VIBRATION DAMPING IN A GUIDE VANE RING

[75] Inventor: Herbert Keller, Mülheim, Fed. Rep. of Germany

[73] Assignee: Kraftwerk Union Aktiengesellschaft, Mülheim, Fed. Rep. of Germany

[21] Appl. No.: 478,286

[22] Filed: Mar. 24, 1983

[30] Foreign Application Priority Data

Mar. 25, 1982 [DE] Fed. Rep. of Germany ..... 3211073

[51] Int. Cl.[3] ..... F01D 5/16

[52] U.S. Cl. ..... 415/191; 415/217; 416/500

[58] Field of Search ..... 416/190, 193 A, 500; 415/189, 191, 217, 190

[56] References Cited

U.S. PATENT DOCUMENTS

| | | | |
|---|---|---|---|
| 1,554,614 | 9/1925 | Allen | 416/500 |
| 2,310,412 | 2/1943 | Flanders | 416/190 |
| 3,079,128 | 2/1963 | Burge | 415/191 |
| 3,728,041 | 4/1973 | Bertelson | 415/191 X |
| 3,752,599 | 8/1973 | Pace | 416/500 X |
| 3,847,506 | 11/1974 | Straniti | 416/500 X |

FOREIGN PATENT DOCUMENTS

| | | | |
|---|---|---|---|
| 951871 | 11/1956 | Fed. Rep. of Germany | 416/500 |
| 1112993 | 8/1961 | Fed. Rep. of Germany | 416/500 |
| 1159965 | 7/1965 | Fed. Rep. of Germany . | |
| 1299004 | 7/1969 | Fed. Rep. of Germany . | |

*Primary Examiner*—Robert E. Garrett
*Assistant Examiner*—Joseph M. Pitko
*Attorney, Agent, or Firm*—Herbert L. Lerner; Laurence A. Greenberg

[57] ABSTRACT

Vibration damping guide vane ring assembly of an axial flow turbomachine, including mutually adjacent guide vanes, individual cover plates each being rigidly connected to a respective guide vane forming a cover band of the guide vane ring, the cover plates being frictionally connected to each other and the cover plates of the adjacent guide vanes having wedge-shaped recesses formed therein between the cover plates, and wedge-shaped damping elements having surfaces and being movably inserted in the recesses, each of the wedge-shaped damping elements exerting a vibration damping pressure on the respective cover plates through the surfaces of the damping elements in response to an axial pressure difference across the guide vane ring.

9 Claims, 3 Drawing Figures

DEVICE FOR VIBRATION DAMPING IN A GUIDE VANE RING

The invention relates to a device for vibration damping in a guide vane ring in an axial flow turbomachine, having a cover band of the guide vane ring, which is formed of individual cover plates being rigidly connected to the corresponding guide vanes, the cover plate—being frictionally connected to each other.

Such devices for damping vibrations, in which the frictional interconnection between the cover plates is effected by an elastic pretension of the vane, are known from German Patent DEPS No. 11 59 965 and German Patent DEPS No. 12 99 004. The elastic pretension is generated in this case either by a torsional pretension imparted to the guide vanes during assembly, or by a flextural pretension imparted to the guide vanes during installation. However, for short compact guide vanes with long cords, the elasticity is not sufficient to ensure a reliable frictional interconnection among the cover plates. Vibrations of the guide vanes can therefore occur, particularly in the region of high temperatures, which leads to loosening of the guide vanes and possibly to breakage of the vanes.

It is accordingly an object of the invention to provide a device for vibration damping in a guide vane ring of an axial-flow turbomachine, which overcomes the hereinafore-mentioned disadvantages of the heretofore known devices of this general type, and in which a reliable frictional interconnection between the cover plates is assured, regardless of the elasticity of the guide vanes.

With the foregoing and other objects in view there is provided in accordance with the invention, a vibration damping guide vane ring assembly of an axial flow turbomachine, comprising mutually adjacent guide vanes, individual cover plates each being rigidly connected to a respective guide vane forming a cover band of the guide vane ring, the cover plates being frictionally connected to each other, and the cover plates of the adjacent guide vanes having wedge-shaped recesses formed therein between the cover plates, and wedge-shaped damping elements having surfaces or sides and being movably inserted in the recesses, each of the wedge-shaped damping elements exerting a vibration damping pressure on the respective cover plates through the surfaces of the damping elements in response to an axial pressure difference across the guide vane ring.

U.S. Pat. No. 2,310,412 discloses a device for vibration damping in a guide vane ring of an axial-flow turbomachine, in which wedge-shaped recesses are formed between the cover plates of adjacent rotor blades. Wedge-shaped damping elements are inserted into the recesses and are movable in the radial direction, in such a manner that pressure is exerted on the corresponding cover plates through the flanks or sides of the wedge-shaped damping elements by the action of centrifugal force. However, it has heretofore been considered a disadvantage of this known vibration damping device, that it is suitable only for rotor blade rings and not for guide vane rings (see German Pat. No. 11 59 965, Column 1, Lines 21 to 29).

In contrast thereto, the present invention is based on the insight that the wedge-shaped damping elements inserted between adjacent cover plates can also be used in guide vane rings, if the axial pressure difference across the guide vane ring is utilized for moving the damping elements, instead of relying on the centrifugal force. Accordingly, the shift of the damping elements does not take place in the radial direction in the device according to the invention, but rather in the axial direction or, in the case of diamond-shaped or rhombic cover plates, in accordance with the oblique position of the lateral contact surfaces, in an approximately axial direction. Since the axial width of the cover plates is substantially larger than their radial height, damping elements with a longer and slimmer shape can be used due to the longer, available shift distance. With slimmer damping elements and a longer shift distance, however, lateral pressures are obtained in spite of the smaller shifting forces, which are sufficient for reliable vibration damping of the guide vanes.

In accordance with another feature of the invention, the cover plates have surfaces facing each other, the wedge-shaped recesses are formed in the surfaces, and the recesses and damping elements are tapered in axial direction.

In accordance with a further feature of the invention, each two adjacent cover plates have a pair of lateral surfaces in contact with each other, and the wedge-shaped recesses are formed in only one surface of each pair of contact surfaces. This has the advantage of ensuring that a radial offset between the cover plates of adjacent guide vanes has no effect on the mobility of the damping elements and that the requirements as to manufacturing accuracy in making wedge-shaped recesses can be less stringent.

In accordance with an additional feature of the invention, the wedge-shaped recesses and damping elements have the shape of oblique cylindrical sections. The recesses can then be made by means of a correspondingly inclined milling tool; while for manufacturing the damping elements, only suitable cylinder pins need be cut off in a surface inclined relative to the cylinder axis, or need be milled at an angle accordingly.

In accordance with an added feature of the invention, the lateral contact surfaces have webs integral therewith at ends thereof terminating the recesses in longitudinal direction. In this way, the wedge-shaped damping elements are secured by these webs against falling-out of the wedge-shaped recesses.

In accordance with yet another feature of the invention, each of the webs have a respective pressure equalizing slot formed therein. This is done so that in case the lateral contact surfaces of adjacent cover plates are very closely pressed together, action on the damping elements by the axial pressure difference of the guide vane ring is also assured.

In accordance with yet a further feature of the invention, the sides of the wedge-shaped damping elements have an inclination ratio causing self-locking in the recesses.

In accordance with yet an additional feature of the invention, the inclination ratio is substantially 1:10.

In accordance with again another feature of the invention, the guide vanes have respective vane bases at ends thereof opposite the cover plates, the adjacent guide vanes having further wedge-shaped recesses formed therein between the vane bases, and including further wedge-shaped damping elements having surfaces or sides and being movably inserted in the further recesses, each of the further wedge-shaped damping elements exerting a vibration damping pressure on the respective vane bases through the surfaces of the further damping elements in response to an axial pressure difference across the guide vane ring.

In accordance with again a further feature of the invention, each two adjacent vane bases have a pair of lateral surfaces in contact with each other, and the further wedge-shaped recesses are formed in only one surface of each pair of contact surfaces.

In accordance with a concomitant feature of the invention, the further wedge-shaped recesses and damping elements have the shape of oblique cylindrical sections.

Other features which are considered as characteristic for the invention are set forth in the appended claims.

Although the invention is illustrated and described herein as embodied in a device for vibration damping in a guide vane ring, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
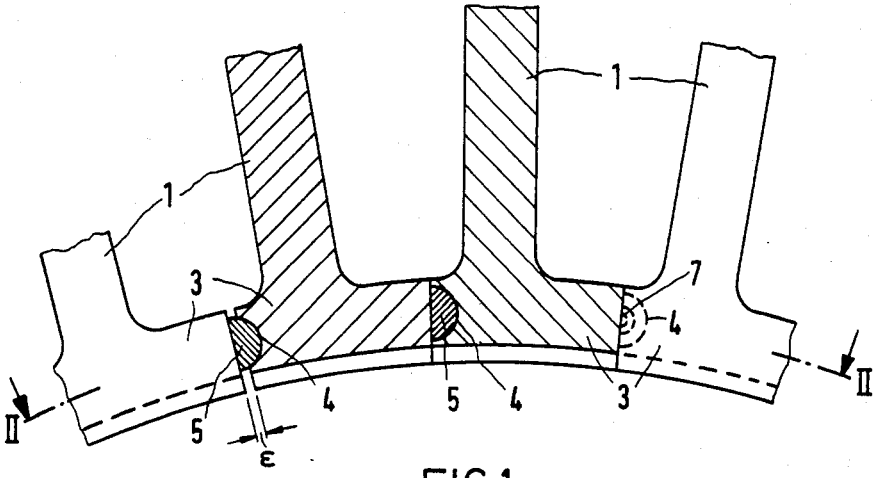
FIG. 1 is a fragmentary, partially cross-sectional and partially axial top plan view of a guide vane ring of a steam turbine.

Referring now to the figures of the drawing in detail, and first particularly to FIG. 1 thereof, there is seen a section of a guide vane ring, the individual guide vanes 1 of which are constructed with a vane base 2 in the shape of a hammer head (see FIG. 3) and with an integral cover plate 3. The individual cover plates 3 of the guide vanes 1 form a cover band which is closed in the circumferential direction. The cover plates 3 are in frictional connection with each other in order to generate a damping which is so strong that no appreciable vibration amplitudes of the guide vanes 1 can be generated. For this purpose, wedge-shaped recesses 4 are formed in one of the two lateral contact surfaces between the cover plates 3 of adjacent guide vanes 1, and wedge-shaped damping elements 5 are inserted into the recesses.

Figure 2:
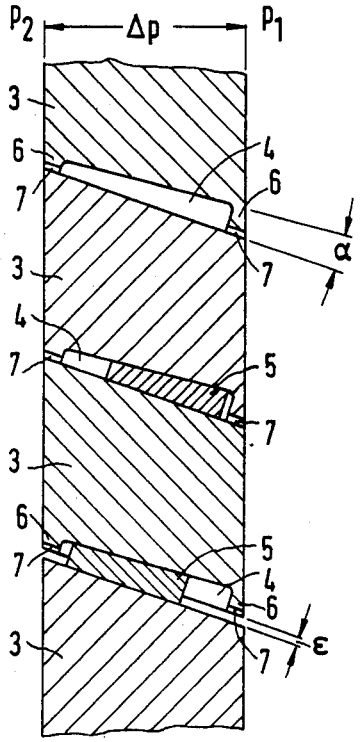
FIG. 2 is a fragmentary cross-sectional view in the circumferential direction of the cover band of the guide vane ring, taken along the line II—II in FIG. 1, in the direction of the arrows.

For a further explanation of the device for vibration damping, which is formed by the wedge-shaped recesses 4 and the wedge-shaped damping elements 5, reference is first made to FIG. 2. In the cross section shown in FIG. 2 taken through the cover band, the wedge-shaped damping element 5 provided between two adjacent cover plates 3 has been omitted in the upper part of the cross-sectional view so that the contour of the corresponding wedge-shaped recesses 4 can be better seen. This contour of a wedge-shaped recess 4 is formed by a cylindrical surface and its intersections with two planes normal to the cylinder axis and a plane inclined relative to the cylinder axis. The plane which is inclined relative to the cylinder axis tapers into the plane of the lateral contact surface of the corresponding cover plate 3. The wedge angle $\alpha$ formed between the lateral contact surface and a generatrix line of the cylinder contour is approximately 5°, which corresponds approximately to an inclination ratio of 1:10. The extent of a wedge-shaped recess 4 in the direction of its longitudinal axis is matched to the width of the lateral contact surface of the corresponding cover plate 3, in such a way that small webs 6 remain on both sides, which serve as security to prevent the wedge-shaped damping elements 5 from falling out.

If a pressure $p_1$ prevails at the entrance of the guide vane ring, and if a lower pressure $p_2$ prevails at the exit of the guide vane rings, the axial pressure difference $\Delta p = p_1 - p_2$ acts on the wedge-shaped damping elements 5 which are disposed in the wedge-shaped recesses 4. In order to ensure this effect even in the case of closely adjacent lateral contract surfaces of the cover plates 3, small pressure equalizing slots 7 are formed in the webs 6. In the middle portion of the cross-sectional view shown in FIG. 2, a wedge-shaped damping element 5 is inserted into the wedge-shaped recess 4 formed between two adjacent cover plates 3. The outer contour of the wedge-shaped damping element 6 corresponds in this case to the inner contour of the wedge-shaped recesses 4, although the length is adjusted so that it can be moved in the direction of the wedge-shaped taper, under the action of the axial pressure difference $\Delta p$. Under the action of the axial pressure difference $\Delta p$, the cylindrical flank or side of the damping element 5 in this case is pressed against the cylindrical contour of the wedge-shaped recess 4, while at the same time the inclined planar flank or surface of the damping element 5 is pressed against the lateral contact surface of the adjacent cover plate 3. In the lower part of the cross-sectional view shown in FIG. 2, it is shown that the wedge-shaped damping elements 5 can also bridge a narrow gap $\epsilon$ between adjacent cover plates 3. If such a gap $\epsilon$ is formed, the corresponding wedge-shaped damping element 5 is driven-in under the action of the axial pressure difference $\Delta p_1$ so far that a vibration-damping pressure between the adjacent cover plates 3 is again ensured. The width of the gap $\epsilon$ and the corresponding width of the wedge-shaped damping element 5 are shown in a heavily exaggerated manner in the drawing, to illustrate the operation.

FIG. 2 shows also that in the embodiment example shown, diamond-shaped or rhombic cover plates 3 are provided, so that according to the inclined position of the lateral contact surfaces, the direction of action of the wedge-shaped damping elements 5 is also inclined relative to the axial direction of the guide vane ring. Since this inclination is not very large, the vibration damping obtained under the action of the axial pressure difference $\Delta p$ is not adversely affected.

Figure 3:
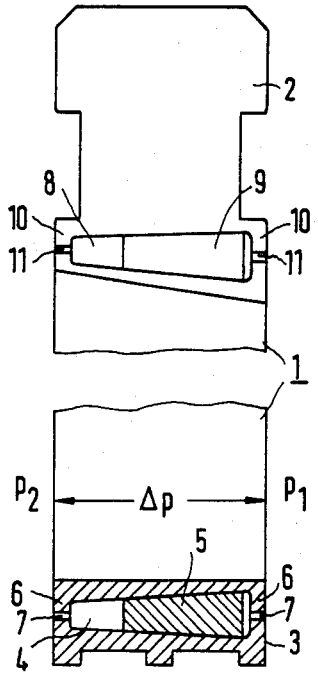
FIG. 3 is a fragmentary top plan view of the lateral contact surface of a guide vane of the guide vane ring shown in FIG. 1.

FIG. 3 shows a guide vane 1 with a vane base 2 constructed as a hammer head and with an integral cover plate 3, in a lateral top plan view. The lateral contact surface of the cover plate 3 and the planar flank of the wedge-shaped damping element 5 are shown with shading in order to better emphasize the contours. In the position shown, which corresponds to the assembled position of the guide vane 1, the lateral contact surfaces of the cover plate 3 and the planar flank or side of the wedge-shaped damping element 5 lie in one plane. If the wedge-shaped damping element 5 is moved from the position shown to the left under the action of the axial pressure difference $\Delta p$, its planar flank emerges from the plane of the lateral contact surface of the cover plate 3, so that the vibration-damping pressure between adjacent cover plates 3 is increased.

With the geometry of the wedge-shaped damping elements 5 shown, a moving force of 10N and a theoretical pressure of 110N exerted on the pressure plates 3 is calculated, assuming a frictionless wedge. However, under transient operating conditions, the wedge-shaped damping elements 5 are driven-in substantially further. Since the wedge-shaped damping elements 5 are furthermore self-locking, substantially larger pressures are therefore obtained in normal operation, than those theoretically calculated.

The device for vibration damping explained with the aid of the drawing can optionally also be combined with other measures provided for vibration damping. For instance, the damping elements 5 can also be used with guide vane rings in which the individual guide vanes 1 are given a torsional pretension or a flexural pretension during assembly.

According to FIG. 3, a further improvement of the vibration damping can also be achieved by additionally connecting the vane bases or feet 2 in a frictional manner. To this end, further wedge-shaped recesses 8 are formed between the respective vane bases 2 of adjacent guide vanes 1 in one of the two lateral contact surfaces, and further wedge-shaped damping elements 9 are inserted therein. The structure and operation of the further wedge-shaped damping elements 9 inserted into the further wedge-shaped recesses 8, correspond in this case to the structure and operation of the wedge-shaped damping elements 5 inserted into the wedge-shaped recesses 4. In other words, the vibration-damping pressure between the vane bases 2 is likewise achieved by the action of the axial pressure difference $\Delta p$ of the guide vane ring. Accordingly, further webs 10, having further pressure equalization slots 11 formed therein, are provided on both sides of the further wedge-shaped recesses 8, to securely prevent the further wedge-shaped damping elements 9 from falling out.

The foregoing is a description corresponding to German Application No. P 32 11 073.1, dated Mar. 25, 1982, International priority of which is being claimed for the instant application, and which is hereby made part of this application. Any discrepancies between the foregoing specification and the aforementioned corresponding German application are to be resolved in favor of the latter.

I claim:

1. Vibration damping guide vane ring assembly of an axial flow turbomachine, comprising mutually adjacent guide vanes disposed between first and second spaces on opposite sides of the guide ring vane ring, individual cover plates each being rigidly connected to a respective guide vane forming a cover band of the guide vane ring, said cover plates being frictionally connected to each other at mutual contact surfaces thereof;

said cover plates of said adjacent guide vanes having wedge-shaped recesses formed in said contact surfaces between said cover plates, said recesses defining inclined surfaces of said cover plates extended between a wider and a narrower end of said recesses, and wedge-shaped damping elements being movably inserted in said recesses, said damping elements having surfaces matching said inclined surfaces of said cover plates extended between a wider and a narrower end of said damping elements;

said wider ends of said recesses and said wider ends of said damping elements being in communication with said first space, said narrower ends of said recesses and said narrower ends of said damping elements being in communication with said second space, said first space having a greater pressure than said second space defining an axial pressure difference, each of said wedge-shaped damping elements being pressed into said recesses for exerting a vibration damping pressure on said respective cover plates through said surfaces of said damping elements in response to said axial pressure difference across the guide vane ring during operation of the turbomachine.

2. Assembly according to claim 1, wherein said wedge-shaped recesses are formed in one surface of each pair of mutual contact surfaces.

3. Assembly according to claim 2, wherein said wedge-shaped recesses and damping elements have the shape of oblique cylindrical sections.

4. Assembly according to claim 3, wherein said mutual contact surfaces have webs integral therewith at ends thereof terminating said recesses in longitudinal direction, each of said webs having a respective pressure equalizing slot formed therein.

5. Assembly according to claim 2, wherein said mutual contact surfaces have webs integral therewith at ends thereof terminating said recesses in longitudinal direction, each of said webs having a respective pressure equalizing slot formed therein.

6. Assembly according to claim 1, wherein said surfaces of said wedge-shaped damping elements have an inclination ratio of substantially 1:10 between said wider and narrower ends thereof causing self-locking in said recesses.

7. Assembly according to claim 1, wherein said guide vanes have respective vane bases at ends thereof opposite said cover plates, said adjacent guide vanes having further wedge-shaped recesses formed therein between said vane bases, and including further wedge-shaped damping elements having surfaces and being movably inserted in said further recesses, each of said further wedge-shaped damping elements exerting a vibration damping pressure on said respective vane bases through said surfaces of said further damping elements in response to an axial pressure difference across the guide vane ring.

8. Assembly according to claim 7, wherein each two adjacent vane bases have a pair of lateral surfaces in contact with each other, and said further wedge-shaped recesses are formed in one surface of each pair of contact surfaces.

9. Assembly according to claim 8, wherein said further wedge-shaped recesses and damping elements have the shape of oblique cylindrical sections.

* * * * *